US011274680B2

(12) United States Patent
Short et al.

(10) Patent No.: US 11,274,680 B2
(45) Date of Patent: Mar. 15, 2022

(54) EJECTOR DEVICE

(71) Applicant: Transvac Systems Limited, Alfreton (GB)

(72) Inventors: Gary Anthony Short, Alfreton (GB); Jacob Thomas Roberts, Alfreton (GB); Thomas Peter More, Alfreton (GB)

(73) Assignee: Transvac Systems Limited, Alfreton (GB)

( * ) Notice: Subject to any disclaimer, the term of this patent is extended or adjusted under 35 U.S.C. 154(b) by 239 days.

(21) Appl. No.: 16/476,931

(22) PCT Filed: Jan. 9, 2018

(86) PCT No.: PCT/GB2018/050042
§ 371 (c)(1),
(2) Date: Jul. 10, 2019

(87) PCT Pub. No.: WO2018/130818
PCT Pub. Date: Jul. 19, 2018

(65) Prior Publication Data

US 2019/0331139 A1 Oct. 31, 2019

(30) Foreign Application Priority Data

Jan. 11, 2017 (GB) ..... 1700463

(51) Int. Cl.
*F04F 5/42* (2006.01)
*F04F 5/46* (2006.01)
*F04F 5/04* (2006.01)

(52) U.S. Cl.
CPC ..... *F04F 5/42* (2013.01); *F04F 5/04* (2013.01); *F04F 5/46* (2013.01); *F04F 5/463* (2013.01)

(58) Field of Classification Search
CPC ..... F04F 5/42; F04F 5/46; F04F 5/463; F04F 5/04–08
(Continued)

(56) References Cited

U.S. PATENT DOCUMENTS 92,313 A * 7/1869 Hughes ..... F04F 5/52 417/187
541,781 A * 6/1895 Wheeler ..... B01F 5/0428 261/76

(Continued)

FOREIGN PATENT DOCUMENTS

EP 3568599 B1 5/2021
GB 197684 3/1924

(Continued)

OTHER PUBLICATIONS

American Gas Association (AGA) "A Review of the Application of Jet Pump Technology to Increase Oil or Gas Production" Paper from the 1998 Spring A.G.A. Storage Operations Conference (20 pages) (1998).

(Continued)

*Primary Examiner* — Alexander B Comley
(74) *Attorney, Agent, or Firm* — Myers Bigel, P.A.

(57) ABSTRACT

An ejector device (1), e.g., for pumping a gas using a liquid motive fluid, has an injector portion (100), and a diffuser portion (50), the injector portion (100) being arranged for injecting a flow of motive fluid from a motive fluid inlet (10) into an inlet section (52) of the diffuser portion (50) thereby to draw a suction fluid from a suction fluid inlet (20) into the inlet section (52) of the diffuser portion (50). The injector portion (100) includes a flow-modifying arrangement with at least one rotational deflector element (104), e.g., three vanes (104V1, 104V2, 104V3) each at a desired twist angle, constructed and arranged to deflect motive fluid into a helical path as it moves over or through the rotational (Continued)

deflector element (104), and at least one baffle element (103), e.g., a baffle plate (103), downstream of the rotational deflector element (104).

18 Claims, 8 Drawing Sheets

(58) Field of Classification Search
USPC ..... 417/187, 194, 198
See application file for complete search history.

(56) References Cited

U.S. PATENT DOCUMENTS 857,920 A 6/1907 Boekel
1,739,600 A * 12/1929 Loth ..... F04F 5/04 417/198
2,804,341 A * 8/1957 Bete ..... B05B 1/262 239/501
3,134,338 A * 5/1964 Dodge ..... F04F 5/466 417/194
3,277,660 A * 10/1966 Kemper ..... F25B 41/00 62/116
3,662,960 A * 5/1972 Mitchell ..... F02K 9/52 239/400
3,680,793 A * 8/1972 Tate ..... B05B 1/3436 239/468
3,688,511 A * 9/1972 Rudolf Harmstrof .. E02F 3/925 405/159
3,938,738 A * 2/1976 Nagel ..... B01F 3/0876 239/9
4,162,971 A * 7/1979 Zlokarnik ..... B01F 5/0268 210/620
5,082,426 A * 1/1992 Sasaki ..... B60K 15/077 180/314
5,322,222 A * 6/1994 Lott ..... B05B 7/0408 239/396
5,454,696 A * 10/1995 Wilkinson ..... F04F 5/44 239/432
6,210,123 B1 * 4/2001 Wittrisch ..... F04F 5/466 417/194
8,622,715 B1 * 1/2014 Lott ..... F04F 5/463 417/198
9,051,900 B2 * 6/2015 Teng ..... F02B 31/04
9,242,260 B2 * 1/2016 Stevenson ..... B01F 5/043
2010/0276517 A1 * 11/2010 Alansary ..... B05B 7/0416 239/399
2013/0216352 A1 * 8/2013 Short ..... F04F 5/10 415/1
2015/0285271 A1 * 10/2015 Beg ..... F04F 5/54 417/194
2015/0345840 A1 * 12/2015 Yokoyama ..... F04F 5/54 62/500

FOREIGN PATENT DOCUMENTS

GB 197684 A * 3/1924 ..... F04F 5/42
GB 2384027 4/2006
JP H07117080 5/1995
WO 2012059773 5/2012
WO 2015189628 12/2015
WO WO-2015189628 A1 * 12/2015 ..... F04F 5/463

OTHER PUBLICATIONS

CALTEC "Wellcom Boost System Development (Phase I)" CALTEC Project No. 303-7643 & 303-7651 (4 pages) (1996).
CALTEC "The Applications of Surface Jet Pump Technology to Increase Oil & Gas Production" Presentation (55 pages) (2011).
Cover letter and emails of communication of observations from a third party corresponding to GB Application No. GB1700463.1 (23 pages) (dated Nov. 8, 2017).
Cunningham, R.G. "Gas Compression With the Liquid Jet Pump" Journal of Fluids Engineering, 96(3):203-215 (1974).
Cunningham et al. "Jet Breakup and Mixing Throat Lengths for the Liquid Jet Gas Pump" Journal of Fluids Engineering, 96(3):216-226 (1974).
Cunningham, R.G. "Liquid Jet Pumps for Two-Phase Flows" Journal of Fluids Engineering, 117(2):309-316 (1995).
Hijet International "Hijet Compression Systems for Flare Gas Recovery" Presentation (34 pages) (2005).
International Search Report and the Written Opinion of the International Searching Authority corresponding to International Patent Application No. PCT/GB2018/050042 (14 pages) (dated Apr. 3, 2018).
Search Report under Section 17 corresponding to GB Application No. GB1700463.1 (2 pages) (dated Sep. 12, 2017).
Thermopedia "Jet Pumps and Ejectors" http://thermopedia.com/content/902/ (1 page) (2017).

* cited by examiner

EJECTOR DEVICE

RELATED APPLICATIONS

This application is a 35 U.S.C. § 371 national phase application of International Patent Application Serial No. PCT/GB2018/050042, filed Jan. 9, 2018, which claims priority to Great Britain Application No. 1700463.1, filed Jan. 11, 2017, the entire contents of each of which are incorporated by reference herein.

TECHNICAL FIELD

This invention relates to an ejector device. More particularly, though not exclusively, it relates to an ejector device for the pumping of fluids. The invention relates even more particularly, though not exclusively, to a fluid inlet or injector arrangement for use in such an ejector device.

BACKGROUND OF THE INVENTION AND PRIOR ART

Ejector devices are well known for the pumping of fluids, e.g. liquids or gases. Known ejector devices typically employ a relatively high pressure fluid (the "motive" fluid) to compress a relatively low pressure fluid (the "entrained" or "suction" fluid) to an intermediate pressure. The fluid at intermediate pressure is then ejected from the ejector device as a "discharge" fluid. Examples of such ejector devices which employ a motive liquid to pressurise a gas may often be termed a "liquid jet compressor" or a "Venturi pump". Ejector devices have an advantage over many conventional mechanical pumps in that they can have substantially no moving parts, so may therefore enjoy a substantially longer service life in many practical applications.

FIG. 1 of the accompanying drawings shows an example of a typical known form of ejector device. The ejector device 1 has a motive fluid inlet portion 10 through which a motive fluid can enter the device 1. The motive fluid may for example be pumped by a pump (not shown) into and through the motive fluid inlet or injector portion 10. The velocity of the motive fluid increases as it passes through a conical nozzle portion 40 of the device 1 before being injected through an outlet aperture 44 of the nozzle portion 40 at an apex thereof into an inlet aperture 52 of a diffuser portion 50. The diffuser portion 50 provides a fluid conduit in the form of a Venturi tube, in which, passing from the inlet aperture 52 of the diffuser portion 50 towards an outlet aperture 54 thereof, a diameter of the conduit initially decreases along a first length of the diffuser portion 50 to a diameter less than that of the inlet aperture 52, then remains at that reduced diameter for a short distance, and then along a second length of the diffuser portion 50 the diameter of the conduit increases towards the outlet aperture 54 of the diffuser portion 50.

The outlet aperture 44 of the nozzle portion 40 and the inlet aperture 52 of the diffuser portion 50 are in fluid communication with a suction fluid inlet portion 20 of the device 1. As a flow of motive fluid flows out from the outlet aperture 44 of the nozzle portion 40 and into the diffuser portion 50, the motive and suction fluids are mixed, and this results in a transfer of momentum and thus kinetic energy from the motive fluid to the suction fluid. This is accompanied by a reduction in the flow velocity of the combined fluids and an increase in the pressure of the suction fluid phase. It is to be noted that this is a reverse process to that occurring in the nozzle portion 40 where an increase in motive fluid velocity occurs, thereby reducing a pressure of the motive fluid as it exits the nozzle portion 40 through its outlet aperture 44.

In practical applications of ejectors of the type shown in FIG. 1, the motive fluid may be a liquid or a gas or any other suitable fluid, and the suction fluid may independently also be a liquid or a gas or any other suitable fluid. However, in many particularly useful applications such ejector devices may be used to pressurise and thus pump gaseous fluids, in which case the motive fluid may typically be a liquid phase and the suction fluid may be the gaseous phase to be pumped.

A problem often found with many known designs of ejector device is that they can achieve only limited compression of the "entrained" or "suction" fluid, especially when it is a gas. This places practical limits on such devices' usefulness for pumping gases and other fluids at relatively high pressures. This limited compression of the suction fluid phase has been recognised as resulting from limited transfer of momentum and thus kinetic energy from the motive fluid to the suction fluid as its passes through the device.

Hitherto there have been various attempts at ameliorating this problem of limited momentum and thus kinetic energy transfer from the motive fluid to the suction fluid, often in particular by incorporating in the device means for imparting a degree of rotational motion to the body of motive fluid as it passes through the input nozzle portion and comes into contact with the suction fluid upon entering the diffuser portion of the device. Examples of prior proposals of this type of device include the use of twisted deflector fins in the motive fluid inlet (for example as disclosed in U.S. Pat. No. 857,920) or the provision of helical slots or channels in the element that defines the motive fluid inlet conduit (for example as disclosed in U.S. Pat. Nos. 2,804,341, 3,680,793 and 5,322,222). However, such known attempts at generating higher levels of compression in the suction fluid represent only moderate improvements at best, and they still cannot achieve levels of compression that are often desirable in many practical applications, especially those in which relatively high pressure pumping of gases phases is desirable.

SUMMARY OF THE INVENTION

In further researching the above problem, but without intending to be bound by theory, we have now found that a major factor in influencing the efficiency of transfer of momentum and thus kinetic energy from the flow of motive fluid to the suction fluid phase is the rate at which the flow of motive fluid breaks up from its generally linear or helical flow path as it exits the inlet or injector nozzle portion of the device and entrains the suction fluid phase as it moves towards the inlet of the diffuser portion. We have now found that the efficiency of transfer of momentum and thus kinetic energy from the flow of motive fluid to the suction fluid phase may be enhanced by arranging for the flow of motive fluid to break up from its generally linear or helical flow path, once it has exited the inlet or injector portion of the device, more quickly than has hitherto been the case. We have found this to be achievable by suitably designing the inlet or injector portion of the device such that unique fluid flow patterns are generated in the motive fluid flow as it exits the inlet or injector portion of the device.

Thus, it is a primary object of the present invention to provide an ejector device, and in particular a novel inlet or injector arrangement therefor, which is able to achieve an enhanced level of momentum and thus kinetic energy transfer from the flow of motive fluid to the suction fluid phase, thereby leading to enhanced levels of compression of a suction fluid by a given motive fluid than has hitherto been possible using prior art ejector devices, by optimising the rate of break-up of the motive fluid flow as it exits the inlet or injector portion of the device and entrains the suction fluid phase.

Other objects and advantages of the invention or embodiments thereof may be apparent from the further definitions and descriptions which follow below of embodiments of the invention and particular features thereof.

SUMMARY OF THE INVENTION

Embodiments of the invention in its various aspects may be understood with reference to the appended claims.

In various of its aspects, the present invention provides an ejector device, an injector arrangement for an ejector device, a pumping apparatus comprising the ejector device, and a method of pumping a fluid using the ejector device or an apparatus comprising the ejector device.

In one aspect of the present invention for which protection is sought there is provided an ejector device comprising:

- an injector portion, and
- a diffuser portion,
- the injector portion being arranged for injecting a flow of motive fluid from a motive fluid inlet into an inlet section of the diffuser portion thereby to draw a suction fluid from a suction fluid inlet into the inlet section of the diffuser portion;
- wherein the injector portion comprises a flow-modifying arrangement comprising:
  - at least one rotational deflector element constructed and arranged to deflect motive fluid into a helical path as it moves over or through the rotational deflector element, and
  - at least one baffle element located downstream of the rotational deflector element.

As used herein the terms "injector portion" and "inlet portion" are to be understood as meaning the same thing, and such terms may even be used interchangeably in the context of this invention and embodiments and features thereof.

In implementing some embodiments of the invention, the components of the injector portion may be designed with various shapes, configurations and/or orientations which may achieve a particular desirable flow behaviour of generating certain defined components of flow of the motive fluid, as will be discussed further hereinbelow.

To this end, in many practical embodiments of the invention the injector portion comprises the above-defined flow-modifying arrangement comprising:

- at least one rotational deflector element constructed and arranged to deflect motive fluid into a helical path as it moves over or through the rotational deflector element, and
- at least one baffle element located downstream of the rotational deflector element.

In some practical embodiment forms at least one rotational deflector element may be provided which comprises a plurality of helical deflector vanes configured and/or arranged for imparting a component of rotation to the motive fluid as its passes the said vanes. In some such embodiment forms, each said deflector vane may have:

- a longitudinal length being approximately equal to or less than a diameter of the injector portion; and
- a radial twist angle of greater than approximately 30°.

As used herein the term "radial twist angle" means the angle, measured in a plane perpendicular to a longitudinal axis of the deflector element, through which the respective deflector vane twists in space as it extends along its length in a direction parallel to the said longitudinal direction of the deflector element.

In some embodiment forms the radial twist angle of each deflector vane may be in the general range of from greater than about 30° up to about 720°.

For example, in some such embodiment forms the radial twist angle of each deflector vane may be ≤90°, such as in the range of from about 30 or 35 or 40° up to about 80 or 85 or 90°.

In some such embodiments the radial twist angle of each deflector vane may for instance be in the range of from about 40° up to about 60 or 70°.

However, in other such embodiment forms the radial twist angle of each deflector vane may be ≥90°, such as in the range of from about 90 up to about 150 or 180 or 360 or even up to about 720°.

In many embodiments the at least one rotational deflector element may be substantially linear in nature, meaning that the twist angle of its deflector vanes varies substantially linearly with respect to distance therealong in the direction parallel to the longitudinal direction of the rotational deflector element. However, in some other embodiments the at least one rotational deflector element may be substantially non-linear in nature, meaning that the twist angle of its deflector vanes varies substantially non-linearly with respect to distance therealong in the direction parallel to the longitudinal direction of the rotational deflector element.

In some embodiments the rotational deflector element may comprise two or more helical deflector vanes. In some embodiments the rotational deflector element may comprise three, or optionally even four, or possibly even more than four, helical deflector vanes. Three deflector vanes may be preferred in many cases, because it may tend to maximise rotation into a helical path of the motive fluid flow whilst minimising frictional losses.

In some embodiments the or each deflector vane may be substantially continuous in its generally longitudinal extent or direction. Alternatively, in other embodiments the or at least one or more of the deflector vanes may be discontinuous over its generally longitudinal extent or direction, for example by virtue of it comprising a plurality of discrete vane portions or segments each spaced from the adjacent or next vane portion or segment in that generally longitudinal extent or direction of the vane. Further alternatively, in yet other embodiments the or at least one or more of the deflector vanes may be discontinuous over its generally longitudinal extent or direction by virtue of it being apertured or perforated in some fashion.

In some embodiments the deflector vanes—or deflector blades, as they may alternatively be termed—may each have a substantially flat (or bluff) profile or face on both their leading and trailing edges. This serves to enhance levels of turbulence and mixing of sections of motive fluid present in the respective chambers defined between respective pairs of the deflector vanes as the motive liquid passes thereover. Alternatively, the leading and/or trailing edges may be tapered in order to reduce turbulence.

In some embodiments the helical motion imparted to the motive fluid by the rotational deflector element may be in the form of a spline line rotation.

In some embodiment forms of the rotational deflector element, each deflector vane or blade may have a longitudinal length which is approximately equal to or less than substantially a single diameter of the injector portion of the ejector device at the location of the injector portion at which the deflector element is located. This dimensioning may thus lead to a rotational deflector element that appears substantially square in side-on and/or top (or bottom) profile. This feature may serve to ensure that an optimum, or sufficiently large, rotational force—and thus a resulting turbulence-inducing helical or component of rotational motion—is imparted to the motive fluid within the shortest longitudinal distance possible, and consequently with as small as possible a potential pressure drop over that longitudinal distance.

For example, by way of comparative explanation, if the rotational configuration of the deflector vanes of the deflector element were instead to extend over a longitudinal length significantly greater than substantially a single diameter of the injector portion of the ejector device, then the efficiency improvements (in terms of minimised potential pressure drop over that longitudinal distance) would be reduced, owing to a longer length of the frictional surfaces of the respective deflector vanes over which the motive fluid must pass.

In some embodiments the rotational deflector element may additionally comprise a longitudinal extension element, e.g. in the form of a spike, protruding longitudinally within the injector portion from a junction between the respective deflector vanes. Such a spike or other extension element may act to disrupt or substantially prevent recirculation of motive fluid passing over the deflector vanes of the deflector element as it exits the deflector element, thereby reducing pressure (and thus energy) losses as the motive fluid passes over the deflector vanes. It may additionally serve to promote pressure equalisation between the respective chambers of the deflector element defined by respective pairs of deflector vanes.

As an alternative to the aforementioned spike as a longitudinal extension element for preventing recirculation of motive fluid passing over the deflector vanes of the deflector element as it exits the deflector element, the rotational deflector element may alternatively additionally comprise a longitudinal aperture, channel or conduit extending through the deflector element at or adjacent a junction between the respective deflector vanes. Such a longitudinally extending channel or conduit may serve to guide a minor proportion of motive fluid through the deflector element in addition to the major proportion thereof passing over the deflector vanes, thereby again stabilising and/or smoothing out the overall passage of motive fluid past the deflector element, helping to reduce pressure (and thus energy) losses as the motive fluid passes over the deflector vanes, and/or serving to promote pressure equalisation between the respective chambers of the deflector element defined by respective pairs of deflector vanes.

In some practical embodiments the flow-modifying arrangement of the injector portion may comprise at least one baffle element in the form of a baffle plate. In some embodiment forms the baffle plate may be substantially planar.

In some such embodiments the generally planar baffle element may be oriented with its general plane substantially parallel to the general direction of flow of the motive fluid passing through the injector portion. In some embodiment forms the generally planar baffle element may be positioned so as to substantially bisect the cross-sectional area of the injector portion containing it, which is to say that it divides the cross-sectional area of the injector portion containing it into two areas of substantially equal area.

In some embodiments the baffle element may be substantially continuous over its overall e.g. planar extent or direction. Alternatively, in other embodiments the baffle element may be discontinuous over its overall e.g. planar extent or direction, for example by virtue of it comprising a plurality of discrete baffle element portions or sections each spaced from an adjacent or next baffle element potion or section in the general e.g. planar extent or direction of the element. Further alternatively, in yet other embodiments the baffle element may be discontinuous over its overall e.g. planar extent or direction by virtue of being apertured or perforated in some fashion.

In many practical embodiment forms the at least one baffle element may be located downstream of the or the respective rotational deflector element and in various rotational and/or longitudinal relative configurations or positions relative to each other.

For instance, in some embodiments the baffle element and the rotational deflector element may be mutually arranged such that:

(i) the general plane of the baffle element and the adjacent or facing end of at least one deflector vane of the rotational deflector element are substantially aligned with or parallel to one another, or (ii) the general plane of the baffle element and the adjacent or facing end of at least one deflector vane of the rotational deflector element are substantially perpendicular to one another; or (iii) the general plane of the baffle element and the adjacent or facing end of at least one deflector vane of the rotational deflector element are offset relative to one another at a non-zero and non-right angle.

In the above case (i), the general plane of the baffle element and the plane of the adjacent or facing end portion of the said deflector vane of the rotational deflector element may thus, when viewed end-on, be oriented at an angle of approximately or substantially 0° relative to each other.

In the above case (ii), the general plane of the baffle element and the plane of the adjacent or facing end portion of the said deflector vane of the rotational deflector element may thus, when viewed end-on, be oriented at an angle of approximately or substantially 90° relative to each other.

In the above case (iii), the general plane of the baffle element and the plane of the adjacent or facing end portion of the said deflector vane of the rotational deflector element may thus, when viewed end-on, be oriented relative to each other at an angle in the approximate range of from about 2 or 5 or 10 or 20 or 30 or 40° up to about 50 or 60 or 70 or 80 or 85 or 88°.

In other example embodiments, optionally in combination (or not) with any of the preceding optional arrangements (i) to (iii), the baffle element may be positioned longitudinally relative to the rotational deflector element such that:

(iv) the baffle element and the rotational deflector element substantially abut each other in a longitudinal direction, or (v) the baffle element and the rotational deflector element are spaced from each other in a longitudinal direction.

In the above case (v), the relative longitudinal spacing between the baffle element and the rotational deflector element may be selected such that any optimum flow characteristics of the motive fluid as its flows through the combined arrangement is achieved. By way of example, such a longitudinal spacing may be anywhere from about 1 or 2 or 5 or 10 or 20% up to about 50 or 60 or 70 or 80 or 90 or 100 (or possibly even more than 100) % of the longitudinal length of the rotational deflector element itself.

Alternatively or additionally to either of the preceding cases (iv) or (v):

(vi) at least one of the baffle element and the rotational deflector element, optionally both of the baffle element and the rotational deflector element, may be at least partially surrounded by or contained substantially within a length portion of the injector portion of reduced internal diameter compared with the diameter of the remainder of the injector portion.

In such an arrangement (vi) the reduced diameter length portion of the injector portion may thus form or constitute a Venturi portion which may serve to improve the flow of the motive fluid as it flows over or through the rotational deflector element and thus through the injector portion.

In various embodiment forms the baffle element may be located in the injector portion either at least partially within, or alternatively immediately upstream of, a converging nozzle portion of the inlet portion of the ejector device.

In practical embodiments the baffle element may be formed of any suitable material, such as a metal or metal alloy, and may be any suitable desired thickness. Generally however the thickness of the baffle element may be sufficient to impart to it a required degree of rigidity or stiffness and strength in order to resist, without deformation, non-longitudinal mechanical forces within the motive fluid flow that may tend to bend or otherwise deform it, but no more than that thickness, so that it does not unduly affect the motive fluid flow characteristics in other ways.

It may be a feature of some embodiments of the invention that the flow-modifying arrangement within the injector portion of the ejector device may act to create, in the motive fluid flow as it exits the injector portion, two or more components of flow of the motive fluid which are directed substantially perpendicular to the general direction of flow thereof and are contra-rotating relative to each other.

Put another way, it may be a feature of some embodiments of the invention that the flow-modifying arrangement within the injector portion of the ejector device may be constructed, configured and arranged to generate, in the motive fluid flow as it exits the injector portion, at least two, or perhaps even a plurality of, secondary flows or secondary flow components contra-rotating relative to one another in a plane or respective planes generally approximately or substantially perpendicular or transverse to the general longitudinal direction of motive fluid flow as its passes through the injector portion of the device.

Such two or more components of perpendicular, contra-rotating flow, or secondary flow, may comprise a plurality of such flows, such as three or even four (e.g. two pairs of) or perhaps even more than four, such flows, or any other number thereof, wherein at least one or more, or some, thereof are contra-rotating relative to at least one other, or some other, thereof. In cases where more than two flows or components of flow of the motive fluid occur, it is to be understood that "contra-rotating" means that at least those flows or flow components that are adjacent one another in a circumferential sense or when viewed in a transverse plane through the injector portion cross-section (or at least one pair of such adjacent flows, in the case of an odd number thereof) are contra-rotating, i.e. rotating in opposite directions, relative to each other.

Such secondary flows or flow components may in practical examples be of significant magnitude, and as a result may be sufficient to accelerate the speed of physical break-up of the motive fluid flow or jet as it exits the injector portion of the device to such a degree that the efficiency with which momentum and thus kinetic energy is transferred from the breaking-up motive fluid as its entrains the suction fluid upon entering the diffuser portion of the device may be markedly increased.

Without being intended to be bound by theory, it is believed that one effect of these contra-rotating secondary flows or flow components may be that they form vortices which collide with one another, and in doing so give rise to axis switching (which as a phenomenon in fluid dynamics is per se well-known), which leads to quicker and more efficient break-up of the motive fluid flow or jet as it exits the injector portion of the device. Furthermore, in embodiments where a baffle element is provided downstream of the secondary flow-inducing rotational deflector element, this effect may in such embodiments be enhanced by physical interactions of the breaking-up flow/jet with the baffle element of the nature of Kelvin-Helmholtz instability (which as a phenomenon is also well-known in the fluid dynamics field), which may act to further speed up and/or intensify the degree of break-up of the motive fluid flow/jet.

Thus, by use of the special flow-modifying arrangement in accordance with the invention, the motive fluid flow or jet may break up, upon exiting the injector portion of the device, sooner than it otherwise would do (in the absence of the special flow-modifying arrangement of the invention). This may lead to improved transfer of kinetic energy from the motive fluid to the suction fluid as the latter is entrained by the former, thereby leading to improved levels of compression of the suction fluid phase and thus improved pumping characteristics of the ejector device.

Furthermore, by use of the invention significantly lower losses of axial/longitudinal momentum of the motive fluid flow may be achieved, which as such may maximise the ratio between flow/jet momentum and break-up time. In practical terms this may translate to a minimising of the reduction in the coefficient of discharge of the injector portion of the device, which may lead to an overall more efficient ejector device.

In another aspect of the present invention for which protection is sought there is provided an injector arrangement for an ejector device, the injector arrangement being an injector portion as defined hereinabove in the context of the ejector device of the first aspect of the invention.

Thus, according to this preceding further aspect there is provided an injector arrangement for use in, or when used in, an ejector device, the ejector device comprising the said injector arrangement and a diffuser portion, wherein:

the injector arrangement is constructed and arranged for injecting a flow of motive fluid from a motive fluid inlet into an inlet section of the diffuser portion of the device thereby to draw a suction fluid from a suction fluid inlet into the inlet section of the diffuser portion, and the injector arrangement includes a flow-modifying arrangement comprising:

at least one rotational deflector element constructed and arranged to deflect motive fluid into a helical path as it moves over or through the rotational deflector element, and at least one baffle element located downstream of the rotational deflector element.

Other optional features of the injector arrangement of this aspect may be the same as or correspond to any of those already discussed herein in the context of embodiments of the ejector device of the first aspect of the invention.

In yet another aspect of the present invention for which protection is sought there is provided a pumping apparatus comprising an ejector device according to the first aspect of the invention or any embodiment thereof.

In yet another aspect of the present invention for which protection is sought there is provided a method of pumping a fluid using the ejector device according to the first aspect of the invention or any embodiment thereof, or a pumping apparatus according to the preceding aspect.

Thus, according to this preceding further aspect there is provided a method of pumping a fluid, the fluid to be pumped being a suction fluid, the method comprising:

providing an ejector device comprising:
- an injector portion, and
- a diffuser portion,
- the injector portion being arranged for injecting a flow of motive fluid from a motive fluid inlet into an inlet section of the diffuser portion thereby to draw a suction fluid from a suction fluid inlet into the inlet section of the diffuser portion,
- wherein the injector portion includes a flow-modifying arrangement comprising:
  - at least one rotational deflector element constructed and arranged to deflect motive fluid into a helical path as it moves over or through the rotational deflector element, and
  - at least one baffle element located downstream of the rotational deflector element;

providing a supply of motive fluid;

injecting, via the injector portion of the device, a flow of the motive fluid from the motive fluid inlet into the inlet section of the diffuser portion, whereby suction fluid is drawn from the suction fluid inlet into the inlet section of the diffuser portion and mixed with the injected motive fluid; and passing the mixed motive fluid and suction fluid through the diffuser portion and expelling the mixed motive fluid and suction fluid from the ejector device via a common discharge outlet thereof;

wherein as the motive fluid flow exits the injector portion it passes through the said flow-modifying arrangement comprising the said at least one rotational deflector element and at least one baffle element.

Other optional features of the ejector device or injector portion thereof as used in embodiments of the preceding method aspect may be the same as or correspond to any of those already discussed in the context of embodiments of the ejector device or injector arrangement of other aspects of the invention as discussed herein.

Embodiments of the present invention in its various aspects may be applied in a wide variety of practical applications involving the pumping of a wide variety of "suction" fluids, e.g. gaseous phases, by a wide variety of "motive" fluids, e.g. liquid phases. Various forms of gas compression are especially useful applications of some embodiments of the invention. By way of non-limiting examples, some practical applications in which ejector devices according to various or particular embodiments of the invention may be usefully employed may include any of the following:

(i) Water treatment applications:
- entraining ozone, chlorine or other disinfectant gas for disinfection of water used for e.g. swimming pools, cooling towers, bottling plants, etc;
- entraining atmospheric air for transferring oxygen to remove irons and manganese from borehole water;
- entraining atmospheric air for filtering backwashing and/or scouring of filter media.

(ii) Oil and gas industry applications:
- entraining vent gas;
- de-aeration of seawater;
- entraining header gas for oil/water separation;
- flare gas recovery.

(iii) Effluent treatment applications:
- entraining atmospheric air for transferring oxygen for sewage treatment;
- entraining atmospheric air for transferring oxygen for chemical oxidising purposes;
- entraining atmospheric air for aerating and mixing balance tanks;
- entraining pressurised air for producing "white water" on DAF (dissolved air flotation) plants.

(iv) Process applications:
- entraining $CO_2$ for carbonating soft drinks;
- simultaneous scrubbing and pumping of corrosive gases;
- scrubbing and neutralising of sour gas (e.g. using amines);
- recycling and mixing off-gas with motive liquor for increasing contact time and thus enhancing process reactions.

Other practical applications for particular embodiments of the invention, in addition to those exemplified above, may also be available.

Thus, in some non-limiting practical examples of the use of ejector devices according to embodiments of the invention, any of the following combinations of liquid phase (as the "motive" fluid) and gaseous phase (as the "suction" fluid to be pumped) may be used:

(a) sea water—hydrocarbon(s) (gaseous; single or mixtures thereof);
(b) produced water—hydrocarbon(s) (gaseous; single or mixtures thereof);
(c) water—chlorine;
(d) water—ozone;
(e) water—air;
(f) corn syrup—$CO_2$;
(g) amine(s)—$CO_2$;
(h) amine(s)—hydrocarbon(s) (gaseous; single or mixtures thereof);
(i) amines(s)—sour gas;
(j) sewage—air;
and various other specific liquid—gas combinations.

Within the scope of this application it is envisaged and explicitly intended that the various aspects, embodiments, features, examples and alternatives, and in particular any of the variously defined and described individual features thereof, set out in any of the preceding paragraphs, in the claims and/or in any part of the following description and/or accompanying drawings, may be taken and implemented independently or in any combination. For example, features described in connection with one particular embodiment or aspect are to be considered as applicable to and utilisable in all embodiments of all aspects, unless expressly stated otherwise or such features are, in such combinations, incompatible.

BRIEF DESCRIPTION OF THE DRAWINGS

Embodiments of the present invention in its various aspects will now be described, by way of example only, with reference to the accompanying drawings, in which.

DETAILED DESCRIPTION OF EMBODIMENTS

Figure 1:
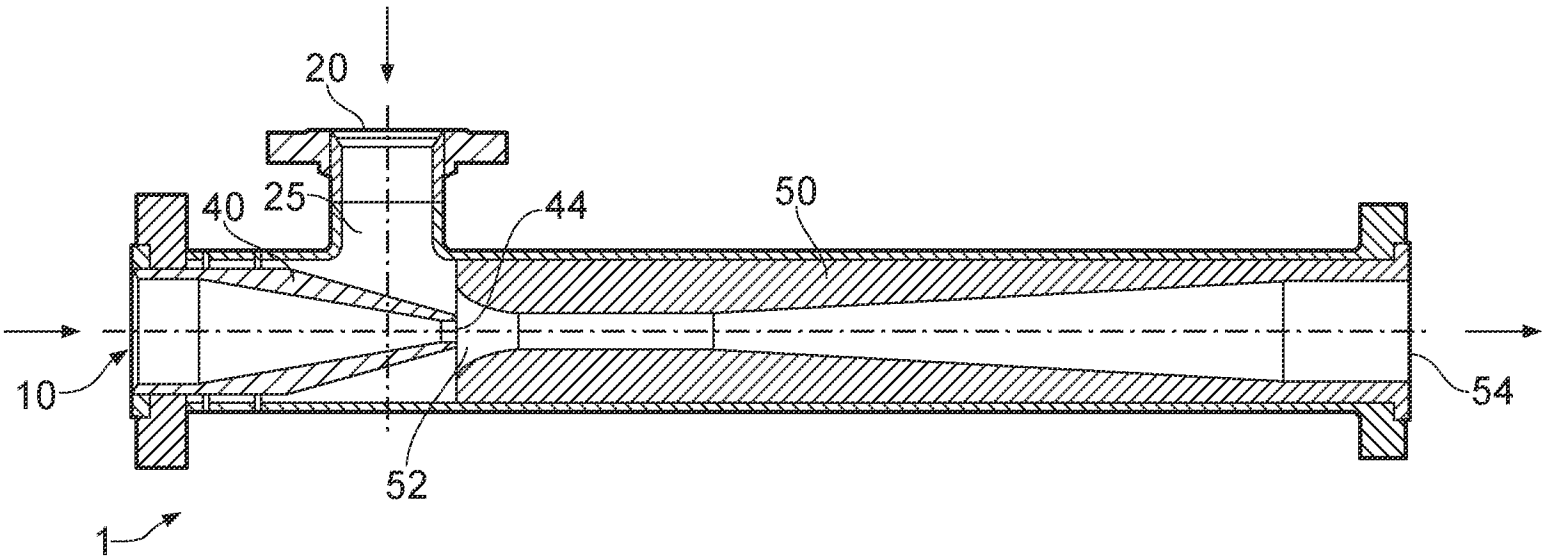
FIG. 1 (Prior Art)
FIG. 1 is a cross-sectional view of a typical prior art ejector device, and has already been described.
Figure 2:
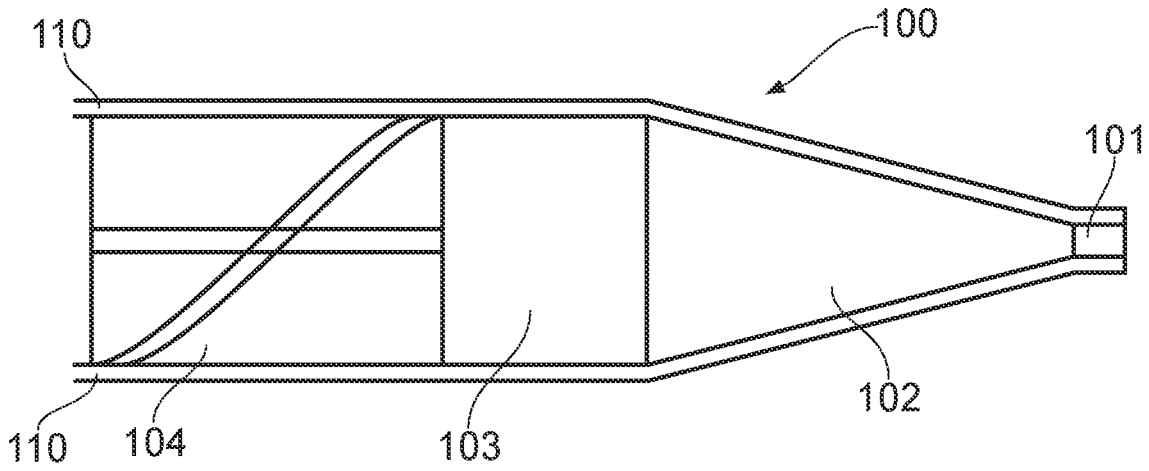
FIG. 2 is a schematic cross-sectional side view of an injector portion of an ejector device according to one embodiment of the invention.
Figure 3:
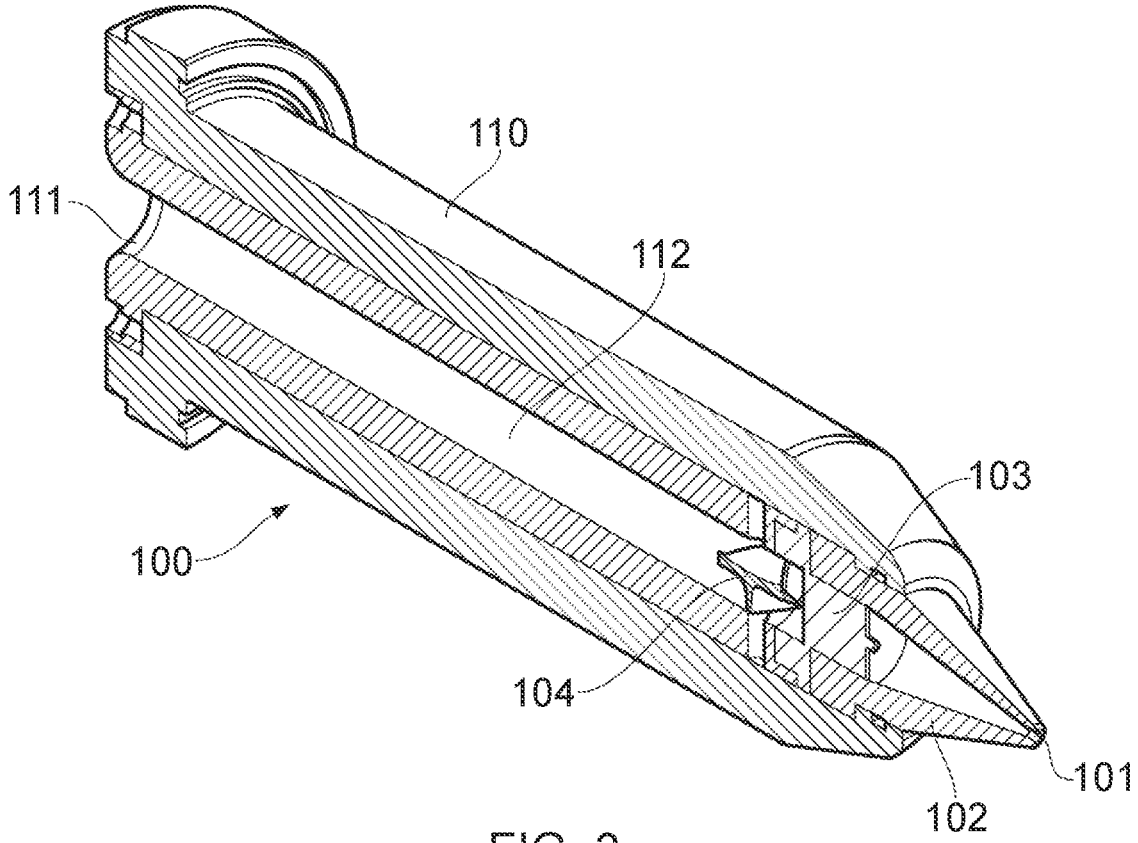
FIG. 3 is a more detailed cross-sectional perspective view of the injector portion of the ejector device of the embodiment shown in FIG. 2.

Referring firstly to FIGS. 2 and 3, here there is shown in simplified (FIG. 2) and in better constructional detail (FIG. 3) an injector portion 100 of an ejector device, which ejector device may otherwise be substantially the same in general overall construction to the known ejector device 1 of FIG. 1. The injector portion 100 comprises generally a cylindrical main body portion 110 having a central bore, conduit or channel 112 through which flows a flow of a motive fluid, e.g. a liquid, which may be pumped into the injector portion 100 from a motive fluid inlet 111 by any suitable conventional pump (not shown).

The inlet portion 110 includes at its forward, downstream end a converging nozzle portion 102 which terminates in a motive fluid outlet or throat 101 via which the flow of motive fluid exits the injector portion 100. The nozzle outlet or throat 101 comprises a short parallel length or bore which defines the nozzle throat bore at the exit of the converging nozzle body 102. The nozzle portion 102 has a converging length between its entry point and its exit which converges typically at an angle of around 20°. The ratio between the diameters of the nozzle portion 102's entry and exit bores may be selected according to known criteria so as to produce a nozzle 102 having a desired motive fluid flow rate appropriate for any given practical application of the ejector device into which it is incorporated.

Following the motive fluid flow's exiting the injector portion 100 it meets and entrains a flow of suction fluid, e.g. a gas, from a suction fluid inlet of the ejector device (such as the arrangement thereof as shown in FIG. 1), which suction fluid is that phase to be pumped by the ejector device.

Located within the injector portion 100, toward the forward (downstream) end of the cylindrical main body portion 110 and adjacent or immediately upstream of the start of the converging nozzle portion 102, is a flow modifying arrangement, the function of which to modify in a novel and characteristic manner the flow of the motive fluid as it passes to the outlet 101 of the nozzle portion 102 is key to the present invention. In this illustrated embodiment of one form of such a flow modifying arrangement, it comprises rotational deflector element 104 and baffle plate 103. The baffle plate 103 is located downstream of the rotational deflector element 104.

Figure 6:
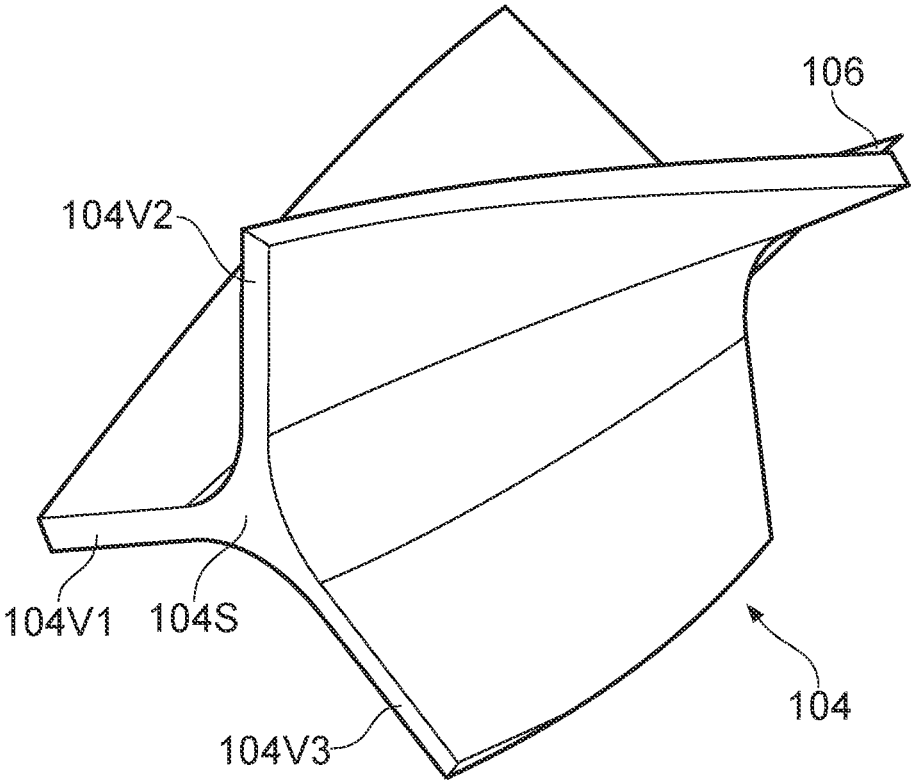
FIG. 6 is a perspective view of the rotational deflector element alone, as used in the embodiment of FIGS. 2 and 3.

The rotational deflector element 104 is constructed and arranged to deflect motive fluid into a helical path as it moves thereover, therepast or therethrough. For this purpose, the rotational deflector element 104 comprises a three-vaned construction as shown in FIG. 6, comprising a central spine 104S extending generally radially outwardly from which are three deflector vanes or blades 104V1, 104V2, 104V3. The deflector vanes or blades 104V1, 104V2, 104V3 are equi-angularly or symmetrically positioned around the central spine 104S so they form a trio of like-shaped longitudinally extending compartments or chambers which divide up the flow of motive fluid passing through and past the deflector element 104 during its passage through the injector portion 100.

Each deflector vane or blade 104V1, 104V2, 104V3 has a generally helical twisted shape or configuration, in order to impart a helical or twisting (or component of rotational) motion to the motive fluid as it passes thereover. The radial twist angle of each deflector vane or blade 104V1, 104V2, 104V3 is greater than approximately 30°, particularly in the range of from greater than about 30° up to about 90°. In a typical embodiment, as illustrated by way of example in FIG. 6, the twist angle of the deflector vanes or blades 104V1, 104V2, 104V3 may be in the region of about 50°, although twist angles of greater than 50°, e.g. up to about 90°, may be possible, for instance generally as long as frictional losses are not increased to unacceptable levels. Both the forward (leading) and rear (trailing) edges or ends of each deflector vane or blade 104V1, 104V2, 104V3 may have a flat or bluff face, in order to increase the level of turbulence caused by the helically rotating chambers of motive fluid as they pass to the nozzle outlet 101.

It is to be understood that in other, alternative, embodiment forms of ejector device according to this invention, albeit not illustrated, radial twist angles of the deflector vanes of the rotational deflector element may be greater than 90°, and may even be substantially greater than 90°, e.g. up to around 150 or 180 or 360 or even up to around 720°. Such high-twist-angle rotational deflector elements may also be usefully employed to good effect in certain alternative embodiment ejector devices within the scope of this invention.

Although, as in FIG. 6, three such deflector vanes or blades 104V1, 104V2, 104V3 are shown in this illustrated embodiment, it is to be understood that any suitable number of deflector vanes or blades may be employed, e.g. 2, 3, 4 or possibly even more than 4. It may generally be preferred however that the number of deflector vanes or blades is not so high that collective frictional losses as the motive fluid passes over them become unacceptably high.

The deflector element 104 is substantially fixed within the bore 112 of the body 110 of the injector portion 100, e.g. by being welded to or mechanically mounted onto the inner wall(s) thereof or perhaps even formed integrally therewith, so that motive fluid is caused to assume a helical motion as it passes over or through the deflector element 104 during its passage through the injector portion 100.

It will be noted, as more readily seen in FIG. 6, that the longitudinal length of the deflector element 104 is approximately equal to or less than a single diameter of the injector portion's main body 110 in which the deflector element 104 is located. Thus, the side-on profile of the deflector element 104 takes the form of an approximate square or rectangle. This serves to ensure that the helical rotation and resulting turbulence are applied to the motive fluid within the shortest longitudinal distance possible, whilst at the same time minimising any pressure drop over that distance. For instance, if the rotational motion applied by the helical deflector vanes or blades 104V1, 104V2, 104V3 were to be generated over a length substantially longer than a single diameter of the injector portion's main body 110, the efficiency improvements may be reduced owing to greater frictional losses against the surfaces of the (in that case) longer deflector vanes or blades.

Projecting from the forward end of the spine 104S of the deflector element 104, especially substantially co-axially with respect thereto, is a spike element 106 with a tapered or sharp forward tip section, which spike 106 serves to not only prevent or disrupt recirculation of motive fluid at the forward end of the deflector element 104, but also to provide a degree of pressure equalisation between the three chambers of fluid defined by the three deflector vanes or blades 104V1, 104V2, 104V3. As an alternative to such a spike 106, it is envisaged that alternatively a longitudinal aperture, channel or conduit (not shown) may be provided extending through the axial centre of the deflector element 104, e.g. through the spine 106 thereof, and thus at or adjacent a junction between the respective deflector vanes or blades 104V1, 104V2, 104V3. In that case, such a longitudinally extending channel or conduit may thus serve to guide a minor proportion of motive fluid through the deflector element 104 in addition to the major proportion thereof passing over the deflector vanes or blades 104V1, 104V2, 104V3, thereby acting in a similar or corresponding way to the spike 106 referred to above.

Figure 5:
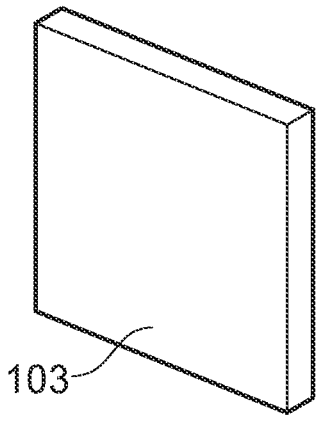
FIG. 5 is a perspective view of the baffle element alone, as used in the embodiment of FIGS. 2 and 3.

As shown in FIG. 5, the baffle plate 103 is in the form of a rectangular flat plate, e.g. of metal or other suitably strong and rigid material, which acts in conjunction with rotational deflector element 104 to modify the flow of motive fluid exiting the injector portion 100 in the novel and characteristic manner required of the present invention. The baffle plate 103 is positioned with its general plane parallel to the longitudinal (i.e. axial) direction of the cylindrical main body portion 110 of the injector portion 100, and so as to bisect the cross-sectional area of that cylindrical body portion 110, i.e. it divides the cross-sectional area of the cylindrical body portion 110 into two areas of substantially equal area.

The baffle plate 103 is relatively thin, although its exact thickness may not be particularly critical, except that preferably it should generally be thick enough (e.g. dependent on the physical properties of the material from which it is formed) to withstand or resist, without deformation, non-longitudinal mechanical forces within the motive fluid flow that may tend to bend or otherwise deform it, but no more than that thickness, so that it does not unduly affect the motive fluid flow characteristics in other ways.

Owing to the combined spatial arrangement of the rotational deflector element 104 and the baffle plate 103, it is believed that the flow-modifying arrangement created thereby causes the flow of motive fluid through and along the central bore, conduit or channel 112 to separate into a plurality of discrete helical secondary flows or flow components which are contra-rotating relative to one another in a plane or respective planes perpendicular to the general longitudinal direction of motive fluid flow through the injector portion 100. Depending on the precise spatial and relative arrangement of the deflector element 104 and baffle plate 103, two or more, possibly even as many as four, such discrete helical secondary flows/flow components may be generated, with adjacent ones (in a circumferential sense) being contra-rotating relative to each other.

In practice such contra-rotating secondary flows or flow components may be of significant magnitude, such that the speed or rate of physical break-up of the overall motive fluid flow or jet as it passes through and out of the nozzle portion 102 of the injector portion 100 is markedly accelerated. As a result, the efficiency with which momentum and thus kinetic energy is transferred from the breaking-up motive fluid flow as it entrains the suction fluid upon exiting the injector nozzle 102 and entering the diffuser portion of the ejector device may be markedly increased, thereby leading to improved levels of compression of the suction fluid phase and thus improved pumping characteristics of the ejector device.

Furthermore, by use of the novel flow modifying arrangement significantly lower losses of axial/longitudinal momentum of the overall motive fluid flow may be achieved, which as such may maximise the ratio between flow/jet momentum and break-up time. In practical terms this may translate to a minimising of the reduction in the coefficient of discharge of the injector portion of the device, which may lead to an overall more efficient ejector device.

Figure 4:
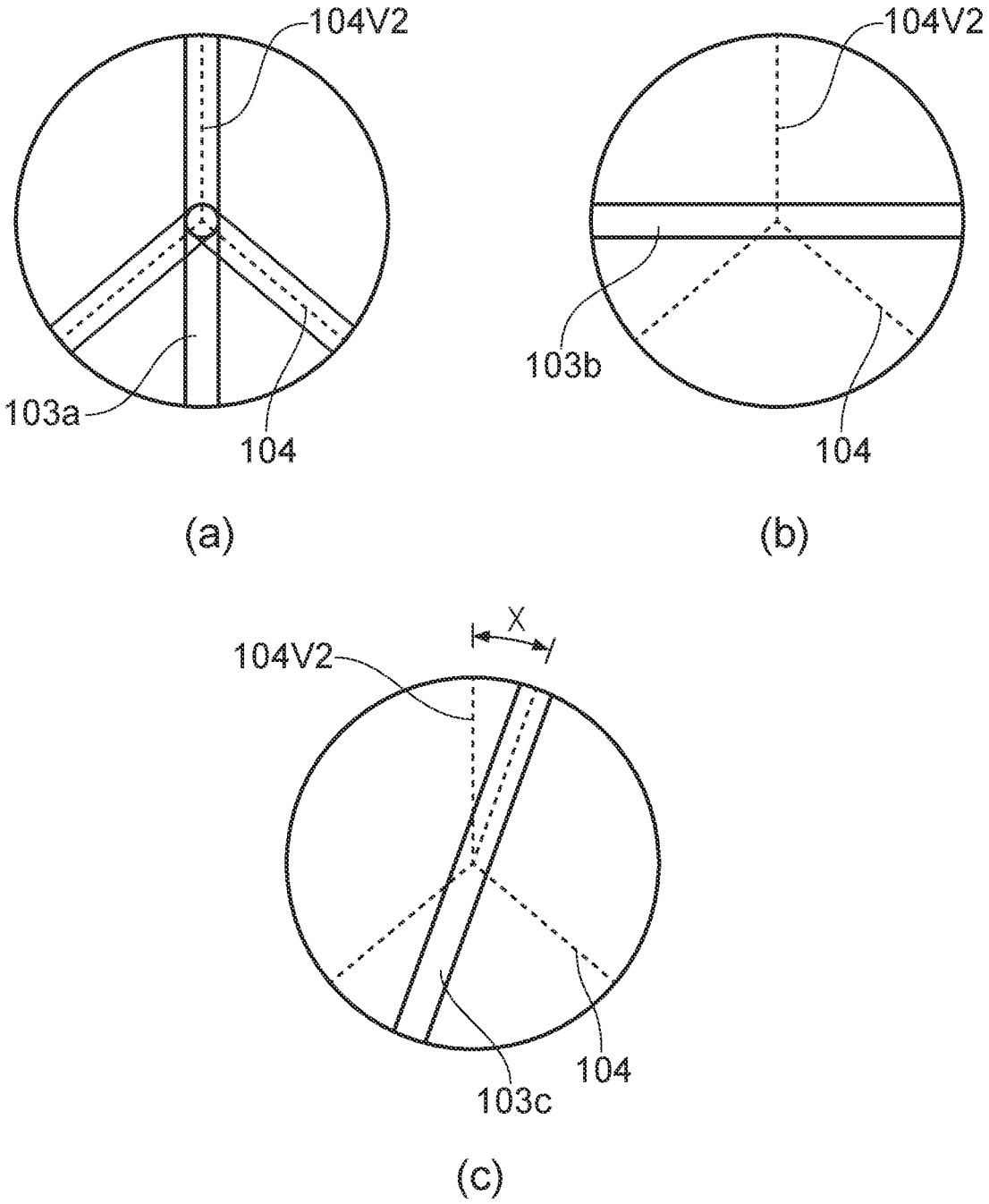
FIGS. 4(*a*), (*b*) and (*c*) are end-on sectional views of three alternative embodiment arrangements in which the rotational deflector element and the baffle element of the injector portion of the ejector device may be arranged rotationally in various positions relative to each other.
Figure 7A:
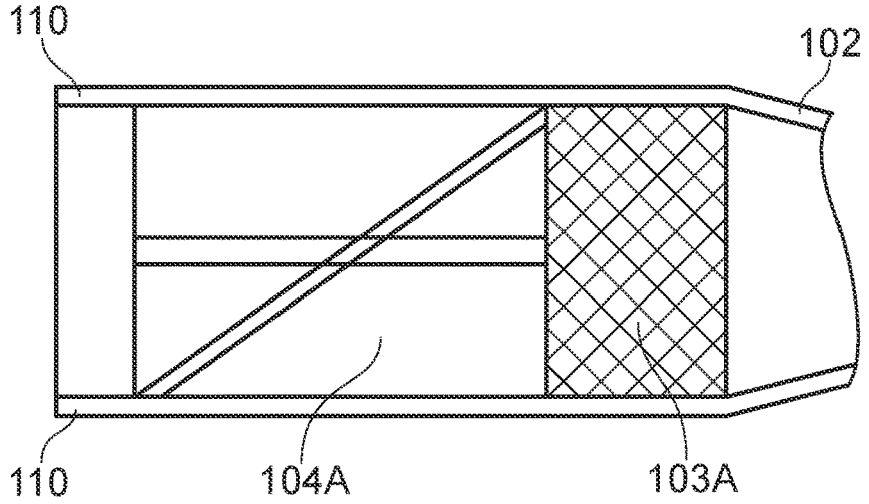
FIGS. 7(*a*), 7(*b*) and 7(*c*) are schematic cross-sectional side views of three yet further alternative embodiment arrangements in which the rotational deflector element and the baffle element of the inlet portion of the ejector device may be arranged longitudinally in various positions relative to each other, possibly with variation of the internal shape of the bore of the injector portion.
Figure 7B:
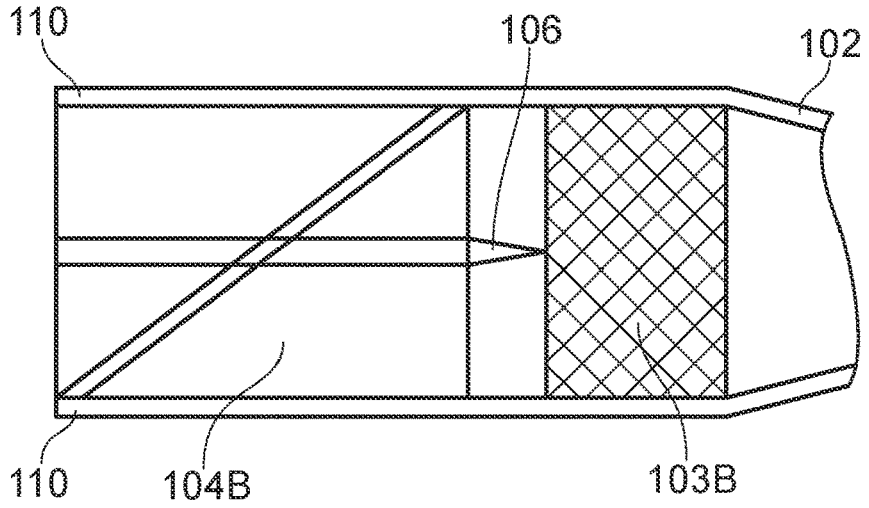
Figure 7C:
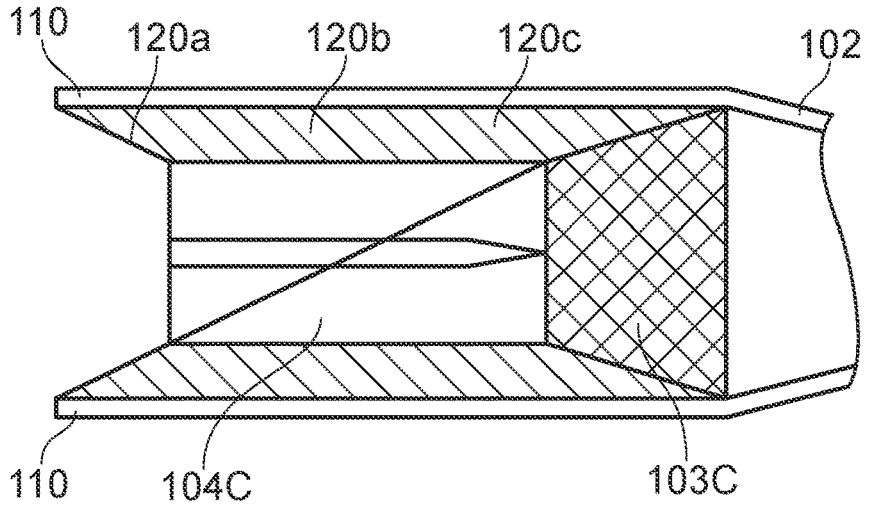

FIGS. 4 and 7 show various variations in the basic constructional and spatial arrangement of the components of the novel flow modifying arrangement of the invention, which may be employed in various practical embodiments to tailor the specific motive fluid flow characteristics in order to optimise the flow modifying behaviour of the system to suit any given practical requirements. For example:

FIGS. 4(*a*), (*b*) and (*c*) show three alternative embodiment arrangements in which the rotational deflector element 104 and the baffle element 103 of the injector portion 100 of the ejector device are arranged rotationally in various positions relative to each other, as follows:

FIG. 4(*a*): the general plane of the baffle element 103 and the adjacent or facing end of one deflector vane, e.g. 104V2, of the rotational deflector element 104 are substantially aligned with or parallel to one another. Thus, the general plane of the baffle element 103 and the plane of the adjacent or facing end portion of the said deflector vane 104V2 of the rotational deflector element 104 is thus, when viewed end-on, oriented at an angle of approximately or substantially 0° relative to each other.

FIG. 4(*b*): the general plane of the baffle element 103 and the adjacent or facing end of at least one deflector vane, e.g. 104V2, of the rotational deflector element 104 are substantially perpendicular to one another. Thus, the general plane of the baffle element 103 and the plane of the adjacent or facing end portion of the said deflector vane 104V2 of the rotational deflector element 104 is thus, when viewed end-on, oriented at an angle of approximately or substantially 90° relative to each other.

FIG. 4(*c*): the general plane of the baffle element and the adjacent or facing end of at least one deflector vane of the rotational deflector element are offset relative to one another at a non-zero and non-right angle, labelled as x. Thus, the general plane of the baffle element 103 and the plane of the adjacent or facing end portion of the said deflector vane

104V2 of the rotational deflector element 104 is thus, when viewed end-on, oriented relative to each other at an angle x in the approximate range of from about 2 or 5 or 10 or 20 or 30 or 40° up to about 50 or 60 or 70 or 80 or 85 or 88°, for example in the range of from about 10 to about 30°.

FIGS. 7(*a*), 7(*b*) and 7(*c*) show three yet further alternative embodiment arrangements (which may in practice optionally be combined with any of the specific embodiment arrangements shown in FIGS. 4(*a*) to (*c*)) in which the rotational deflector element 104 and the baffle element 103 of the inlet portion 100 of the ejector device are arranged longitudinally in various positions relative to each other, possibly with variation of the internal shape of the bore 112 of the injector portion 100, as follows:

FIG. 7(*a*): the baffle element and the rotational deflector element substantially abut each other in a longitudinal direction.

FIG. 7(*b*): the baffle element and the rotational deflector element are spaced from each other in a longitudinal direction, e.g. spaced by a distance anywhere from about 1 or 2 or 5 or 10 or 20% up to about 50 or 60 or 70 or 80 or 90 or 100 (or possibly even more than 100) % of the longitudinal length of the rotational deflector element 104 itself, for example somewhere around 10 to 40% of the longitudinal length of the rotational deflector element 104 itself.

FIG. 7(*c*): alternatively or additionally to either of the variations shown in FIGS. 7(*a*) and 7(*b*), at least one of the baffle element 103 and the rotational deflector element 104, optionally both thereof, is/are at least partially surrounded by or contained substantially within a length portion of the injector portion 100 of reduced internal diameter compared with the diameter of the remainder of the injector portion 100. The length portion of such a reduced diameter may be a central portion 120*b* bounded at an upstream end by a converging portion 120*a* and at a downstream end by a diverging portion 120*c*. Thus, the reduced diameter length portion 120*b* of the injector portion 100 may form or constitute a Venturi portion which may serve to improve the flow of the motive fluid as it flows over or through the rotational deflector element 104 and thus through the injector portion 100.

Figure 8A:
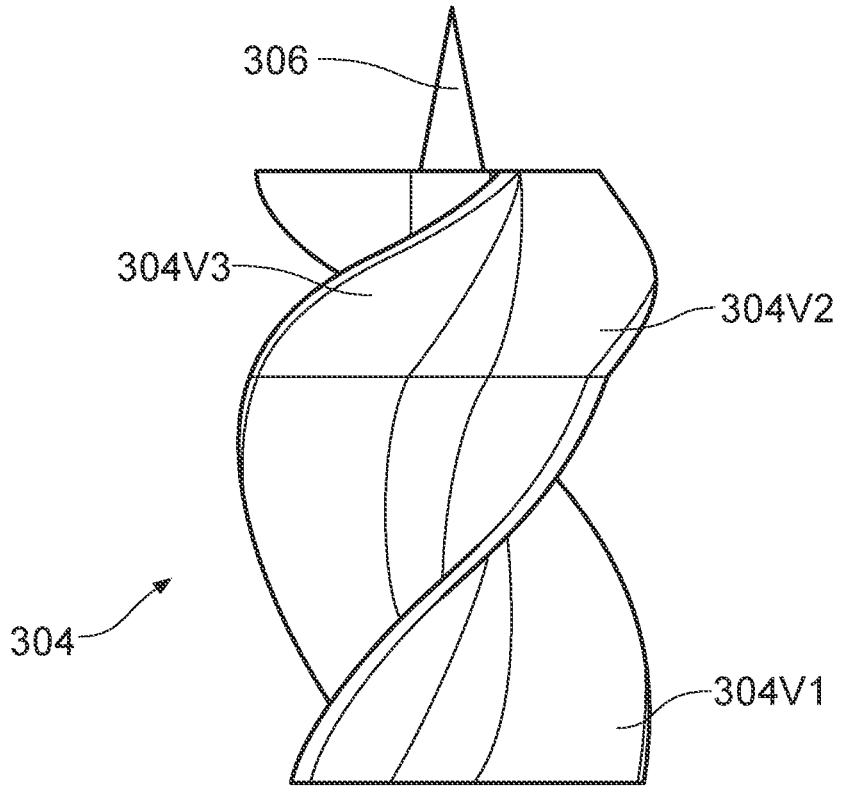
FIGS. 8(*a*) and 8(*b*) are, respectively, a side view and an isometric view of an alternative form of rotational deflector element, which is non-linear in nature, and which may be used in other embodiments of the invention where greater twist angles are required.
Figure 8B:
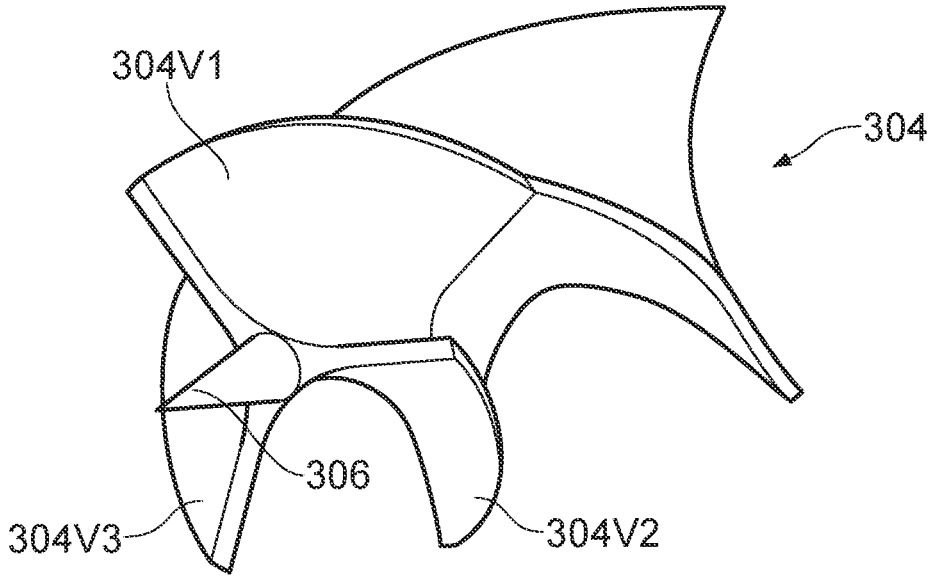

In the embodiment ejector device discussed and described above in relation to FIGS. 2 to 7, it will be noted that the illustrated rotational deflector element 104 is an example of a "linear" such element, meaning that its deflector vanes or blades 104V1, 104V2, 104V3 are configured such that their twist angle varies substantially linearly with respect to the distance along the element 104 in the direction parallel to its longitudinal, i.e. axial, direction. However, in certain other, alternative, embodiments still within the scope of the invention, the rotational deflector element may instead be substantially "non-linear" in nature, meaning that its deflector vanes or blades are configured such that their twist angle varies substantially non-linearly with respect to the distance along the element in that direction parallel to its longitudinal, i.e. axial, direction. An example of such a non-linear rotational deflector element 304 is illustrated in FIGS. 8(*a*) (in side view) and 8(*b*) (in isometric view). As shown therein by way of one example, the deflector vanes or blades 304V1, 304V2, 304V3 are configured such that their twist angles vary substantially non-linearly—and also, by way of example, through a significantly greater twist angle than the vanes/blades in the embodiment of FIG. 6—passing along the element 304 in the direction parallel to, especially coincident with, its longitudinal axis. Also, as in the embodiment of FIG. 6, the central spine of the element 304 terminates at its forward (downstream) end in a tapered spike element 306, which here fulfils substantially the same function as before.

Figure 9:
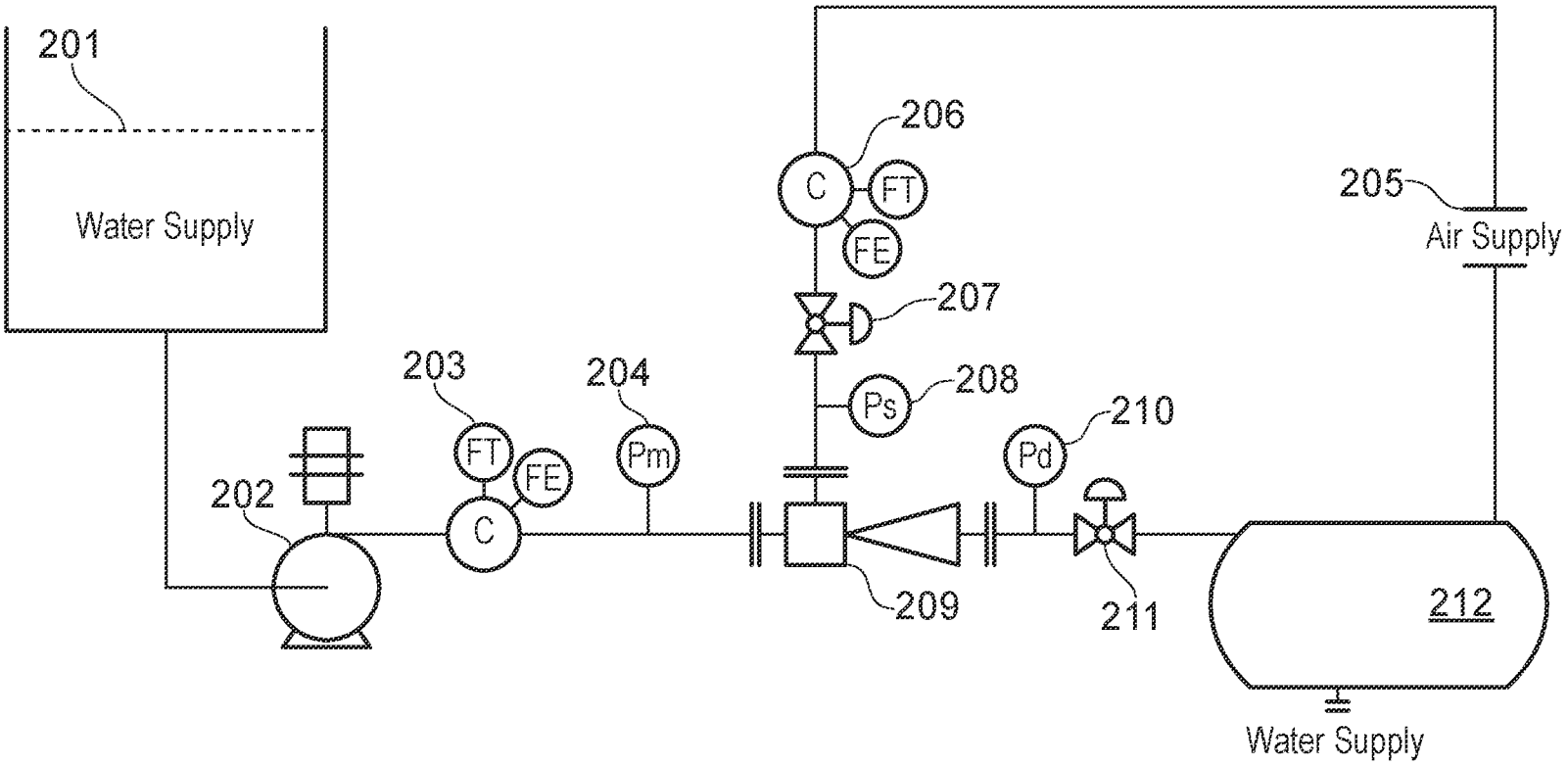
FIG. 9 is a schematic explanatory diagram showing a test apparatus used to test and compare various ejector devices in a comparative test procedure as described hereinbelow, the devices tested being one according to an embodiment of the present invention and another outside the scope thereof.

In order to demonstrate the working advantages to be had from using an ejector device employing the novel injector arrangement according to the present invention, an experimental test procedure was carried out to test and compare a representative embodiment ejector device according to the invention with a known ejector device outside the scope of the invention. The experimental apparatus and procedure, and the results which were obtained, were as follows:

A simplified test apparatus was used in the experiment and is illustrated schematically in FIG. 9. In the FIG. the various components thereof are denoted as follows:

201—5 $m^3$ water tank;
202—high pressure pump;
203—Coriolis meter, rated to 70,000 $m^3$/h;
204—pressure transducer, 0-400 Barg;
205—air supply, provided by air compressor;
206—Coriolis meter, rated to 2,000 $m^3$/h;
207—control valve;
208—pressure transducer, −1-40 Barg;
209—ejector;
210—pressure transducer, 0-40 Barg;
211—control valve;
212—separator.

During the tests the pressure at the three connections of the ejector was monitored and controlled. Motive pressure (Pm) was controlled with the speed of the pump 202; suction pressure (Ps) was controlled with the suction trim valve 207; the discharge pressure (Pd) was controlled with the discharge trim valve 211. The motive pressure (Pm) defines the motive flow rate (Qm) for a given ejector design. The suction flow rate (Qs) is defined by the performance of the ejector design. The parameters Qm and Qs are calculated from readings taken from the Coriolis meters 203, 206, which measured the mass flow and temperature in the suction and motive lines.

The performance of an ejector at a particular duty is defined as the ratio Qs/Qm (Rs) at the specified values of parameters Pm, Ps, and Pd. For a specific set of ejector geometries, a combination of Pm and Ps will be optimum at a specific Pd. This is the most efficient point and is referred to as the duty point.

Two different ejectors were tested: Test piece 1 was a known ejector device employing a known injector nozzle arrangement including a conventional helical deflector element alone—as described and illustrated in our co-pending published International patent application WO 2015/189628 A1 (Transvac Systems Limited). Test piece 2 was an example of the new ejector device employing the novel injector arrangement, comprising helical deflector element in combination with baffle element, according to an embodiment of the present invention—as described above and illustrated in FIG. 3 of the accompanying drawings of this application.

In testing each ejector, each run was carried out using Pm=150 Barg and Ps=0 Barg. Each helical deflector element was 40 mm in diameter in the injector portion of the ejector. The test comprised monitoring the critical values of the various parameters, keeping the Pm and Ps constant and changing the Pd through the full range available. This would give a value K representative of Pd−Ps.

Figure 10:
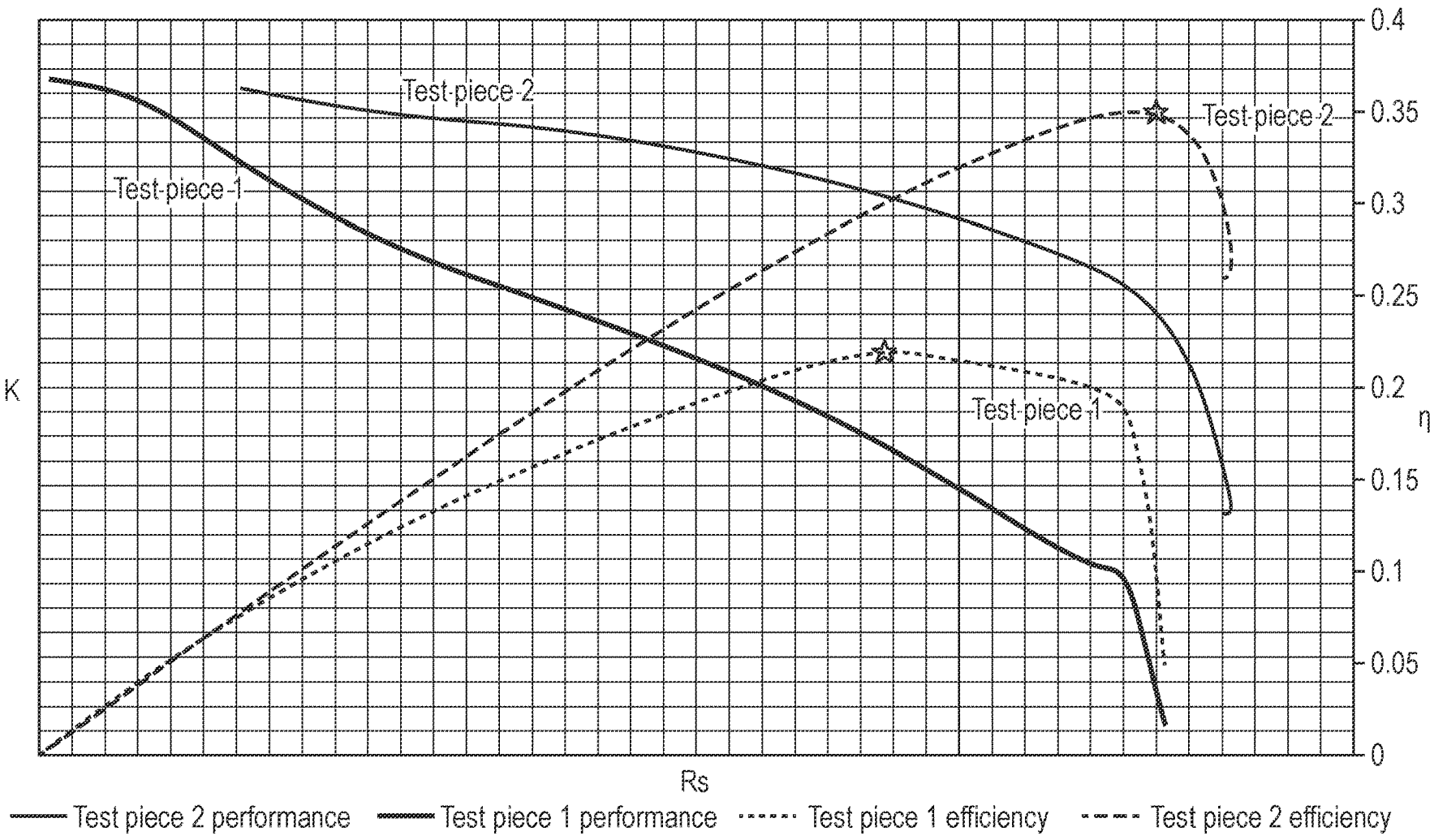
FIG. 10 is a graph showing the results of the test procedure carried out using the apparatus as shown in FIG. 9 and described hereinbelow.

The results obtained, which were normalised, were plotted in terms of ejector performance and ejector efficiency, and the respective graphical plots are shown in FIG. 10.

From the two curves it can be readily seen that in the case of the ejector according to the present invention, in comparison with the known prior art ejector, a substantial improvement in performance was obtained, which equated to a 60% improvement in efficiency. This therefore demonstrates the practical advantages to be had from employing the novel injector arrangement in a novel ejector device in accordance with the present invention.

It is to be understood that the above description of various specific embodiments of the invention has been by way of non-limiting examples only, and various modifications may be made from what has been specifically described and illustrated whilst remaining within the scope of the invention as defined by the appended claims.

Throughout the description and claims of this specification, the words "comprise" and "contain" and linguistic variations of those words, for example "comprising" and "comprises", mean "including but not limited to", and are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

Some further embodiments of various aspects of the present invention may be understood by reference to the following numbered paragraphs:

1. An ejector device comprising:
an injector portion, and
a diffuser portion,
the injector portion being arranged for injecting a flow of motive fluid from a motive fluid inlet into an inlet section of the diffuser portion thereby to draw a suction fluid from a suction fluid inlet into the inlet section of the diffuser portion;
wherein the injector portion includes means for creating, in the motive fluid flow as it exits the injector portion, two or more components of flow of the motive fluid which are directed substantially perpendicular to the general direction of flow thereof and are contra-rotating relative to each other.

2. An ejector device according to paragraph 1, wherein the injector portion comprises a flow-modifying arrangement comprising:
at least one rotational deflector element constructed and arranged to deflect motive fluid into a helical path as it moves over or through the rotational deflector element, and
at least one baffle element located downstream of the rotational deflector element.

3. An ejector device according to paragraph 2, wherein at least one rotational deflector element is provided which comprises a plurality of helical deflector vanes configured and/or arranged for imparting a component of rotation to the motive fluid as its passes the said vanes.

4. An ejector device according to paragraph 3, wherein each said deflector vane has:
a longitudinal length being approximately equal to or less than a diameter of the injector portion; and
a radial twist angle of greater than approximately 30°.

5. An ejector device according to paragraph 4, wherein the radial twist angle of each deflector vane is in the range of from greater than about 30° up to about 720°, optionally in the range of from about 30 or 35 or 40° up to about 80 or 85 or 90°, or optionally in the range of from about 90 up to about 150 or 180 or 360 or 720°.

6. An ejector device according to any one of paragraphs 3 to 5, wherein the rotational deflector element comprises three helical deflector vanes.

7. An ejector device according to any one of paragraphs 3 to 6, wherein:
(i) the or each deflector vane is substantially continuous in its generally longitudinal extent or direction; or
(ii) the or at least one or more of the deflector vanes is discontinuous over its generally longitudinal extent or direction, or is apertured or perforated.

8. An ejector device according to any one of paragraphs 3 to 7, wherein the or each deflector vane has a substantially flat or bluff profile or face on both its leading and trailing edges.

9. An ejector device according to any one of paragraphs 3 to 8, wherein the or each deflector vane has a longitudinal length which is approximately equal to or less than substantially a single diameter of the injector portion of the ejector device at the location of the injector portion at which the deflector element is located.

10. An ejector device according to any one of paragraphs 3 to 9, wherein:
(i) the rotational deflector element additionally comprises a longitudinal extension element, optionally in the form of a spike, protruding longitudinally within the injector portion from a junction between the respective deflector vanes; or
(ii) the rotational deflector element additionally comprises a longitudinal aperture, channel or conduit extending through the deflector element at or adjacent a junction between the respective deflector vanes.

11. An ejector device according to any one of paragraphs 2 to 10, wherein the helical motion imparted to the motive fluid by the rotational deflector element is in the form of a spline line rotation.

12. An ejector device according to any one of paragraphs 2 to 11, wherein the flow-modifying arrangement of the injector portion comprises at least one baffle element in the form of a baffle plate.

13. An ejector device according to paragraph 12, wherein the baffle plate is substantially planar.

14. An ejector device according to paragraph 13, wherein the baffle plate is oriented with its general plane substantially parallel to the general direction of flow of the motive fluid passing through the injector portion.

15. An ejector device according to paragraph 13 or paragraph 14, wherein the baffle plate is positioned so as to substantially bisect the cross-sectional area of the injector portion containing it.

16. An ejector device according to any one of paragraphs 12 to 15, wherein:
(i) the baffle element is substantially continuous over its overall extent or direction; or
(ii) the baffle element is discontinuous over its overall extent or direction, or is apertured or perforated.

17. An ejector device according to any one of paragraphs 3 to 16, as dependent through paragraph 3, wherein the at least one baffle element is located downstream of the or the respective rotational deflector element and the baffle element and the rotational deflector element are mutually arranged such that any one of (i) to (iii) below is satisfied:

(i) the general plane of the baffle element and the adjacent or facing end of at least one deflector vane of the rotational deflector element are substantially aligned with or parallel to one another, or (ii) the general plane of the baffle element and the adjacent or facing end of at least one deflector vane of the rotational deflector element are substantially perpendicular to one another; or (iii) the general plane of the baffle element and the adjacent or facing end of at least one deflector vane of the rotational deflector element are offset relative to one another at a non-zero and non-right angle.

18. An ejector device according to paragraph 17, wherein feature (i) is satisfied and the general plane of the baffle element and the plane of the adjacent or facing end portion of the said deflector vane of the rotational deflector element are, when viewed end-on, oriented at an angle of approximately or substantially 0° relative to each other.

19. An ejector device according to paragraph 17, wherein feature (ii) is satisfied and the general plane of the baffle element and the plane of the adjacent or facing end portion of the said deflector vane of the rotational deflector element are, when viewed end-on, oriented at an angle of approximately or substantially 90° relative to each other.

20. An ejector device according to paragraph 17, wherein feature (iii) is satisfied and the general plane of the baffle element and the plane of the adjacent or facing end portion of the said deflector vane of the rotational deflector element are, when viewed end-on, oriented relative to each other at an angle in the approximate range of from about 2 or 5 or 10 or 20 or 30 or 40° up to about 50 or 60 or 70 or 80 or 85 or 88°.

21. An ejector device according to any one of paragraphs 2 to 20, wherein the baffle element is positioned longitudinally relative to the rotational deflector element such that any one of (iv) to (vi) below is satisfied:

(iv) the baffle element and the rotational deflector element substantially abut each other in a longitudinal direction, or (v) the baffle element and the rotational deflector element are spaced from each other in a longitudinal direction, or (vi) alternatively or additionally to either of the preceding cases (iv) or (v), at least one of the baffle element and the rotational deflector element, optionally both of the baffle element and the rotational deflector element, is at least partially surrounded by or contained substantially within a length portion of the injector portion of reduced internal diameter compared with the diameter of the remainder of the injector portion.

22. An ejector device according to paragraph 21, wherein feature (v) is satisfied and the relative longitudinal spacing between the baffle element and the rotational deflector element is selected so as to be from about 1 or 2 or 5 or 10 or 20% up to about 50 or 60 or 70 or 80 or 90 or 100% of the longitudinal length of the rotational deflector element itself.

23. An ejector device according to any one of paragraphs 2 to 22, wherein the baffle element is located in the injector portion either:

(i) at least partially within, or (ii) immediately upstream of, a converging nozzle portion of the inlet portion of the ejector device.

24. An ejector device according to any one of paragraphs 3 to 23, as dependent through paragraph 3, wherein the at least one rotational deflector element comprises either of:

(i) a linear rotational deflector element in which the twist angle of its deflector vanes varies substantially linearly with respect to distance therealong in the direction parallel to the longitudinal direction of the rotational deflector element; or (ii) a non-linear rotational deflector element in which the twist angle of its deflector vanes varies substantially non-linearly with respect to distance therealong in the direction parallel to the longitudinal direction of the rotational deflector element.

25. An ejector device according to any one of paragraphs 2 to 24, wherein the flow-modifying arrangement within the injector portion of the ejector device is constructed, configured and arranged to generate, in the motive fluid flow as it exits the injector portion, at least two, or a plurality of, secondary flows or secondary flow components contra-rotating relative to one another in a plane or respective planes generally approximately or substantially perpendicular or transverse to the general longitudinal direction of motive fluid flow as its passes through the injector portion of the device.

26. An injector arrangement for use in, or when used in, an ejector device, the ejector device comprising the said injector arrangement and a diffuser portion, wherein:

the injector arrangement is constructed and arranged for injecting a flow of motive fluid from a motive fluid inlet into an inlet section of the diffuser portion of the device thereby to draw a suction fluid from a suction fluid inlet into the inlet section of the diffuser portion, and the injector arrangement includes means for creating, in the motive fluid flow as it exits the injector arrangement, two or more components of flow of the motive fluid which are directed substantially perpendicular to the general direction of flow thereof and are contra-rotating relative to each other.

27. An injector arrangement according to paragraph 26, wherein the arrangement comprises:

at least one rotational deflector element constructed and arranged to deflect motive fluid into a helical path as it moves over or through the rotational deflector element, and at least one baffle element located downstream of the rotational deflector element.

28. A pumping apparatus comprising an ejector device according to any one of paragraphs 1 to 25.

29. A method of pumping a fluid, the fluid to be pumped being a suction fluid, the method comprising:

providing an ejector device comprising:

an injector portion, and a diffuser portion, the injector portion being arranged for injecting a flow of motive fluid from a motive fluid inlet into an inlet section of the diffuser portion thereby to draw a suction fluid from a suction fluid inlet into the inlet section of the diffuser portion, wherein the injector portion includes means for creating, in the motive fluid flow as it exits the injector portion, two or more components of flow of the motive fluid which are directed substantially perpendicular to the general direction of flow thereof and are contra-rotating relative to each other;

providing a supply of motive fluid;

injecting, via the injector portion of the device, a flow of the motive fluid from the motive fluid inlet into the inlet section of the diffuser portion, whereby suction fluid is drawn from the suction fluid inlet into the inlet section of the diffuser portion and mixed with the injected motive fluid, wherein as the motive fluid flow exits the injector portion two or more components of flow are created therein which are directed substantially perpendicular to the general direction of flow of the motive fluid and are contra-rotating relative to each other; and passing the mixed motive fluid and suction fluid through the diffuser portion and expelling the mixed motive fluid and suction fluid from the ejector device via a common discharge outlet thereof.

30. A method according to paragraph 29, wherein the suction fluid to be pumped is a gaseous phase and the motive fluid is a liquid phase.

31. An ejector device, or an injector arrangement, or a pumping apparatus, or a method of pumping a fluid, substantially as any of those described herein with reference to any of FIGS. 2 to 10 of the accompanying drawings.

The invention claimed is:

1. An ejector device comprising: an injector portion, and a diffuser portion, the injector portion being arranged for injecting a flow of motive fluid from a motive fluid inlet into an inlet section of the diffuser portion thereby to draw a suction fluid from a suction fluid inlet into the inlet section of the diffuser portion; wherein the injector portion comprises a flow-modifying arrangement comprising: at least one rotational deflector element constructed and arranged to deflect motive fluid into a helical path as it moves over or through the at least one rotational deflector element, and at least one baffle element located downstream of the at least one rotational deflector element, wherein the at least one baffle element comprises a baffle plate oriented so that the flow of motive fluid flows through the injector portion on opposing sides of the baffle plate, wherein the baffle plate is a single baffle plate that is positioned adjacent a downstream end portion of one rotational deflector element of the at least one rotational deflector element, wherein the baffle plate has a width dimension and is oriented so that the width dimension extends through a center and across an entire cross-sectional width of the injector portion at a segment providing the flow-modifying arrangement.

2. An ejector device according to claim 1, wherein the at least one rotational deflector element comprises a plurality of helical deflector vanes configured and/or arranged for imparting a component of rotation to the motive fluid as the motive fluid passes the helical deflector vanes.

3. An ejector device according to claim 2, wherein each of the helical deflector vanes has:

a longitudinal length equal to or less than a diameter of the injector portion; and a radial twist angle greater than 30°.

4. An ejector device according to claim 2, wherein the plurality of helical deflector vanes comprises three helical deflector vanes.

5. An ejector device according to claim 2, wherein each of the helical deflector vanes has a flat or bluff profile or face on both its leading and trailing edges.

6. An ejector device according to claim 2, wherein each of the helical deflector vanes has a longitudinal length which is equal to or less than a single diameter of the injector portion of the ejector device at a location of the injector portion at which the at least one rotational deflector element is located.

7. An ejector device according to claim 2, wherein:

(i) the at least one rotational deflector element additionally comprises a longitudinal extension element protruding longitudinally within the injector portion from a junction between respective deflector vanes of the helical deflector vanes; or (ii) the at least one rotational deflector element additionally comprises a longitudinal aperture, channel or conduit extending through the at least one deflector element at or adjacent a junction between respective deflector vanes of the helical deflector vanes.

8. An ejector device according to claim 2, wherein the baffle plate and a rotational deflector element of the at least one rotational deflector element are mutually arranged such that any one of (i) to (iii) below is satisfied:

(i) the baffle plate and an adjacent or facing end of at least one deflector vane of the rotational deflector element are aligned with or parallel to one another; or (ii) the baffle plate and an adjacent or facing end of at least one deflector vane of the rotational deflector element are perpendicular to one another; or (iii) the baffle plate and an adjacent or facing end of at least one deflector vane of the rotational deflector element are offset relative to one another at a non-zero and non-right angle.

9. An ejector device according to claim 8, wherein feature (i) is satisfied and the baffle plate and a plane of the adjacent or facing end portion of the at least one deflector vane of the rotational deflector element are, when viewed end-on, oriented at an angle of 0° relative to each other.

10. An ejector device according to claim 8, wherein feature (ii) is satisfied and the baffle plate and a plane of the adjacent or facing end portion of the at least one deflector vane of the rotational deflector element are, when viewed end-on, oriented at an angle of 90° relative to each other.

11. An ejector device according to claim 8, wherein feature (iii) is satisfied and the baffle plate and a plane of the adjacent or facing end portion of the at least one deflector vane of the rotational deflector element are, when viewed end-on, oriented relative to each other at an angle in a range of from 2° to 88°.

12. An ejector device according to claim 1, wherein the baffle plate is planar.

13. An ejector device according to claim 12, wherein the baffle plate is positioned so as to bisect a cross-sectional area of the injector portion containing it.

14. An ejector device according to claim 1, wherein one baffle element of the at least one baffle element is positioned longitudinally relative to one rotational deflector element of the at least one rotational deflector element such that any one of (iv) to (vi) below is satisfied:

(iv) the one baffle element and the one rotational deflector element abut each other in a longitudinal direction; or (v) the one baffle element and the one rotational deflector element are spaced from each other in a longitudinal direction; or (vi) alternatively or additionally to either of the preceding cases (iv) or (v), the at least one of the baffle element and the at least one rotational deflector element are at least partially surrounded by or contained within a length portion of the injector portion of reduced internal diameter compared with a diameter of a remainder of the injector portion.

15. An ejector device according to claim 1, wherein the at least one baffle element is located in the injector portion either:

(i) at least partially within, or (ii) immediately upstream of, a converging nozzle portion of an inlet portion of the ejector device.

16. A pumping apparatus comprising the ejector device of claim 1.

17. A method of pumping a fluid, the fluid to be pumped being a suction fluid, the method comprising:

providing the ejector device of claim 1;

providing a supply of motive fluid;

injecting, via the injector portion of the ejector device, a flow of the motive fluid from the motive fluid inlet into the inlet section of the diffuser portion, whereby suction fluid is drawn from the suction fluid inlet into the inlet section of the diffuser portion and mixed with the injected motive fluid; and passing the mixed motive fluid and suction fluid through the diffuser portion and expelling the mixed motive fluid and suction fluid from the ejector device via a common discharge outlet thereof;

wherein as the motive fluid flow exits the injector portion it passes through said flow-modifying arrangement comprising said at least one rotational deflector element and said at least one baffle element.

18. A method according to claim 17, wherein the suction fluid to be pumped is a gaseous phase and the motive fluid is a liquid phase.

* * * * *